US011739492B2

(12) United States Patent
Caretto

(10) Patent No.: US 11,739,492 B2
(45) Date of Patent: Aug. 29, 2023

(54) MODULAR FOUNDATION ASSEMBLY

(71) Applicant: Robert Caretto, Arabi, LA (US)

(72) Inventor: Robert Caretto, Arabi, LA (US)

( * ) Notice: Subject to any disclaimer, the term of this patent is extended or adjusted under 35 U.S.C. 154(b) by 0 days.

(21) Appl. No.: 17/570,562

(22) Filed: Jan. 7, 2022

(65) Prior Publication Data

US 2023/0220648 A1 Jul. 13, 2023

(51) Int. Cl.
*E02D 27/48* (2006.01)
*B28B 7/20* (2006.01)

(52) U.S. Cl.
CPC ..... *E02D 27/48* (2013.01); *B28B 7/20* (2013.01); *E02D 2200/1657* (2013.01); *E02D 2250/0023* (2013.01); *E02D 2300/002* (2013.01)

(58) Field of Classification Search
CPC ..... E02D 27/016; E02D 27/48; E02D 2200/1657; E02D 2250/0023; E02D 2300/002; B28B 7/20; B28B 7/22; B29C 39/10; B29C 41/38
See application file for complete search history.

(56) References Cited

U.S. PATENT DOCUMENTS 4,290,246 A * 9/1981 Hilsey ..... E04H 3/00 D25/19
4,486,986 A * 12/1984 Cosenza ..... E02D 31/02 405/36
4,726,567 A * 2/1988 Greenberg ..... E04H 17/1404 52/223.7
5,137,391 A * 8/1992 Ballesteros ..... E01F 15/086 404/6
5,375,381 A 12/1994 Park
5,388,318 A 2/1995 Petta
5,429,448 A * 7/1995 Ballesteros ..... E01F 9/669 404/6
6,223,487 B1 * 5/2001 Dinkel ..... E04C 3/22 52/223.13
6,370,835 B1 4/2002 Morgan
8,769,893 B1 * 7/2014 Gill ..... E02D 27/50 52/297
10,538,927 B1 1/2020 Keller
2002/0121063 A1 * 9/2002 Mathias ..... E01F 13/022 52/578
2003/0086761 A1 * 5/2003 Anderson ..... E01F 13/022 404/6
2009/0061722 A1 3/2009 Natori et al.
(Continued)

FOREIGN PATENT DOCUMENTS

CN 107956255 A * 4/2018 ..... B05B 17/085
CN 113006126 A * 6/2021 ..... E02D 29/025
(Continued)

*Primary Examiner* — Frederick L Lagman

(57) ABSTRACT

A modular foundation assembly for building a modular foundation for a home includes a tarp that has a plurality of openings each strategically positioned on the tarp to facilitate the ground to be marked for a foundation. A plurality of concrete forms is provided which each has a trapezoidal shape. In this way each of the concrete forms can be lifted upwardly from a concrete member formed by the concrete forms when the concrete member has cured. Each of the concrete forms has a crenellated edge to form a series of slots into the concrete member. In this way the series of slots in the concrete member facilitate the concrete member to be lifted with a forklift.

11 Claims, 6 Drawing Sheets

(56) References Cited

U.S. PATENT DOCUMENTS

| | | | | |
|---|---|---|---|---|
| 2009/0277031 | A1 | 11/2009 | Stocking | |
| 2011/0061336 | A1* | 3/2011 | Thomas | B66C 23/342 52/745.19 |
| 2016/0060830 | A1* | 3/2016 | Muegerl | E01F 13/00 404/6 |
| 2021/0316474 | A1* | 10/2021 | Johnson | B28B 23/005 |
| 2021/0348801 | A1* | 11/2021 | Krause | F24F 1/62 |

FOREIGN PATENT DOCUMENTS

| | | | | |
|---|---|---|---|---|
| KR | 20140006409 U | * | 12/2014 | E02D 29/025 |
| WO | WO0071824 | | 11/2000 | |

* cited by examiner

MODULAR FOUNDATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to foundation devices and more particularly pertains to a new foundation device for building a modular foundation for a home. The device includes a tarp which has holes at strategic locations which can be laid on the ground for marking the ground at each of the holes. The device includes a plurality of concrete forms that each has a trapezoidal shape such that each of the concrete forms can be lifted upwardly from a concrete member that is cured in the concrete forms. Additionally, each of the concrete forms has a crenellated edge to form a series of slots in the concrete member to facilitate the concrete member to be lifted with a forklift.

(2) Description of Related Art Including Information Disclosed Under 37 CFR 1.97 and 1.98

The prior art relates to foundation devices including a modular building device including a plurality of pre-cut members for constructing a building. The prior art discloses a method of employing laser imaging for building a construction template. The prior art discloses a method of erecting a structure involving locally sourced materials and labor. The prior art discloses a construction template system that includes a laser pointer for locating a proposed structural element. The prior art discloses a measuring tarp device that includes a grid of pre-determined dimensions for facilitating measurements to be made.

BRIEF SUMMARY OF THE INVENTION

An embodiment of the disclosure meets the needs presented above by generally comprising a tarp that has a plurality of openings each strategically positioned on the tarp to facilitate the ground to be marked for a foundation. A plurality of concrete forms is provided which each has a trapezoidal shape. In this way each of the concrete forms can be lifted upwardly from a concrete member formed by the concrete forms when the concrete member has cured. Each of the concrete forms has a crenellated edge to form a series of slots into the concrete member. In this way the series of slots in the concrete member facilitate the concrete member to be lifted with a forklift.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
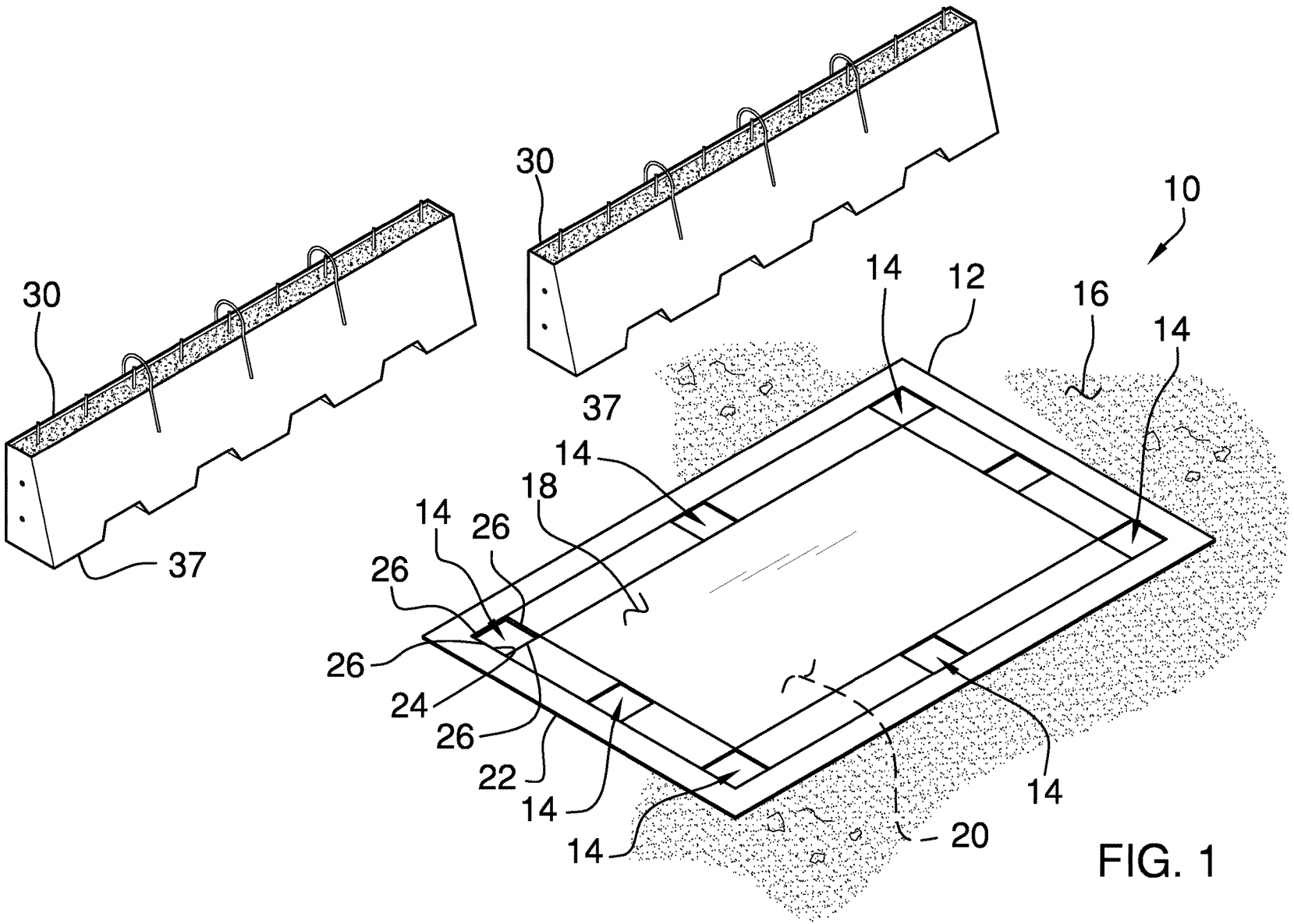
FIG. 1 is a top perspective view of a modular foundation assembly according to an embodiment of the disclosure.
Figure 2:
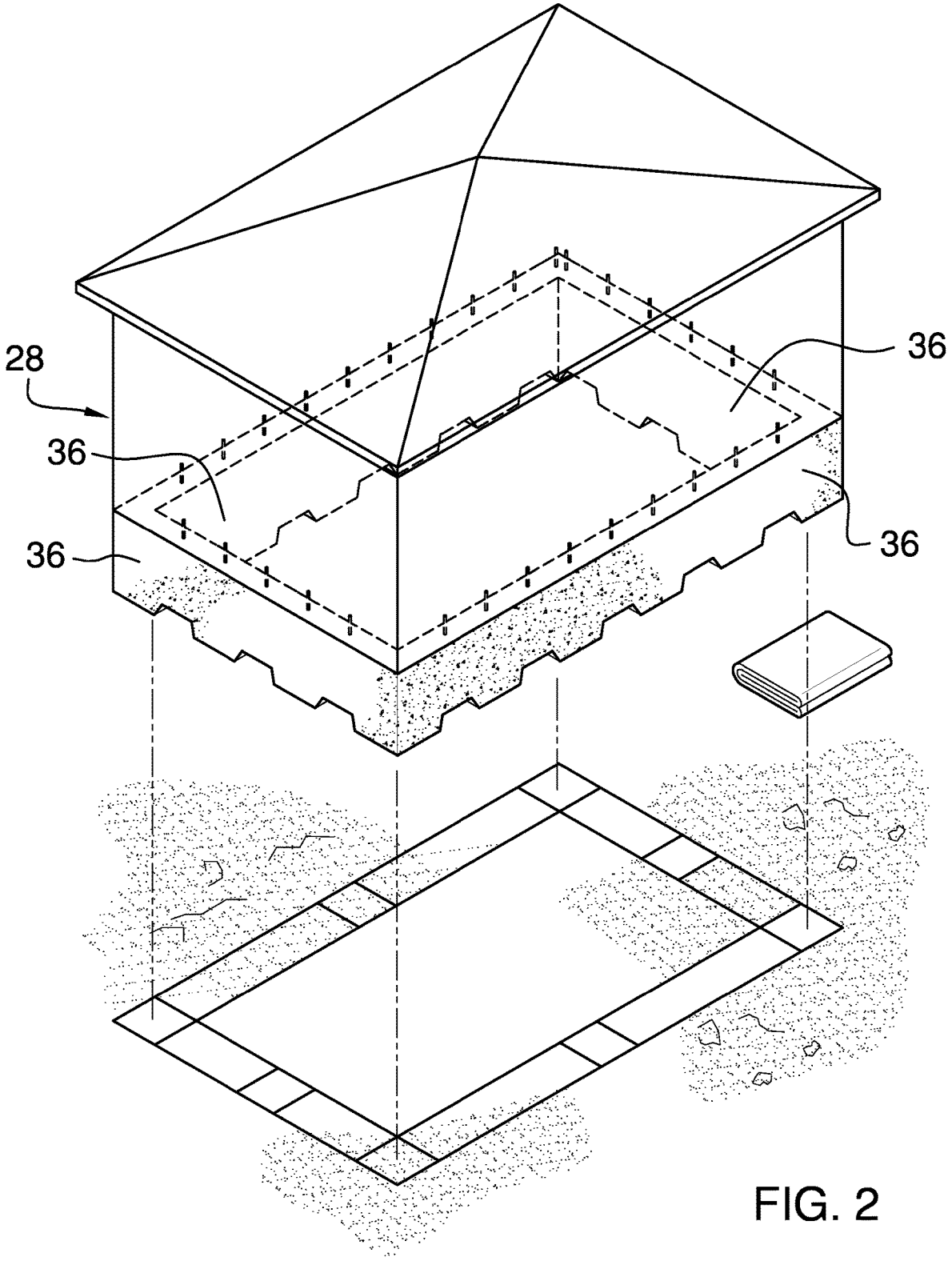
FIG. 2 is an exploded perspective view of a foundation having been constructed with concrete forms of an embodiment of the disclosure.
Figure 3:
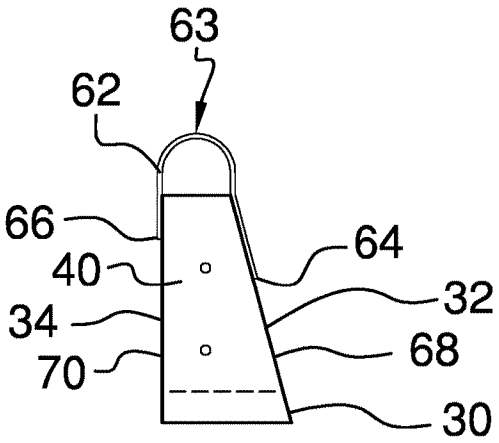
FIG. 3 is a right side view of a concrete form of an embodiment of the disclosure.
Figure 4:
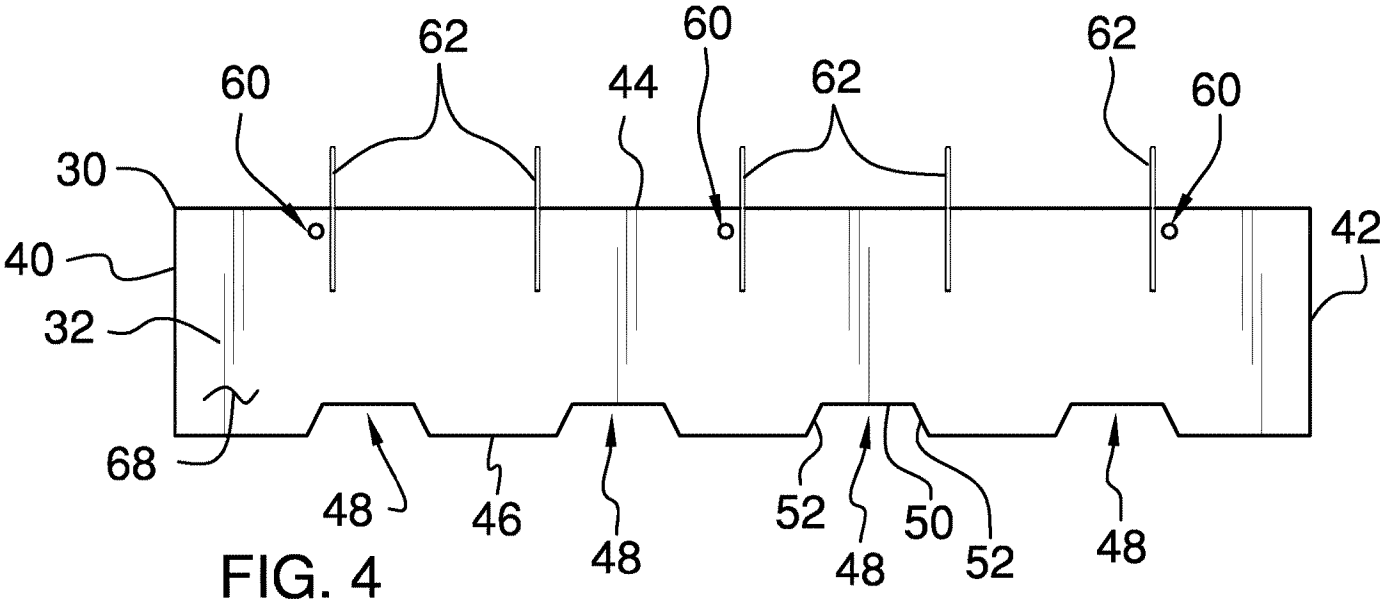
FIG. 4 is a front view of a concrete form of an embodiment of the disclosure.
Figure 5:
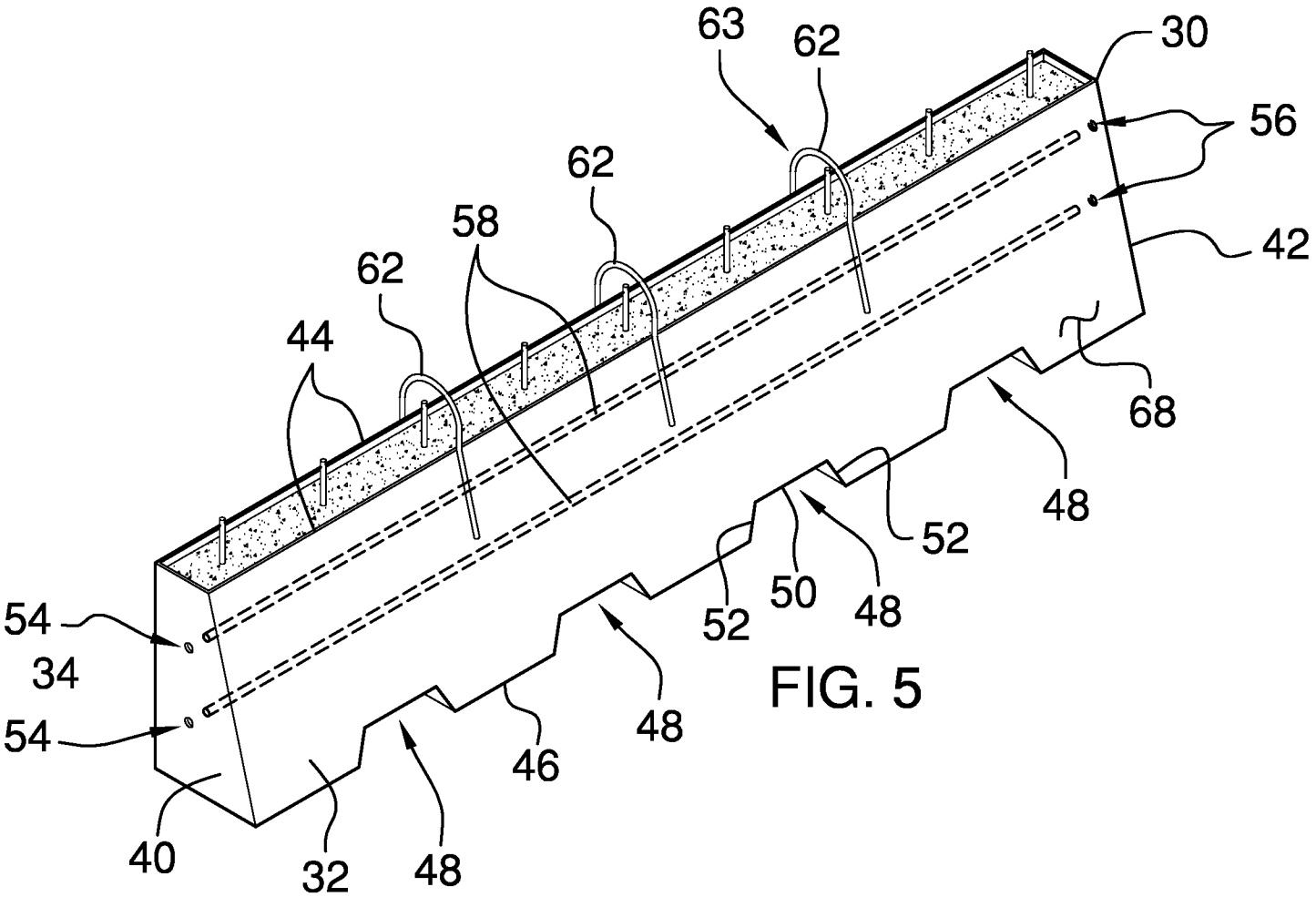
FIG. 5 is a top perspective view of concrete form an embodiment of the disclosure showing concrete having been poured into a concrete form.
Figure 6:
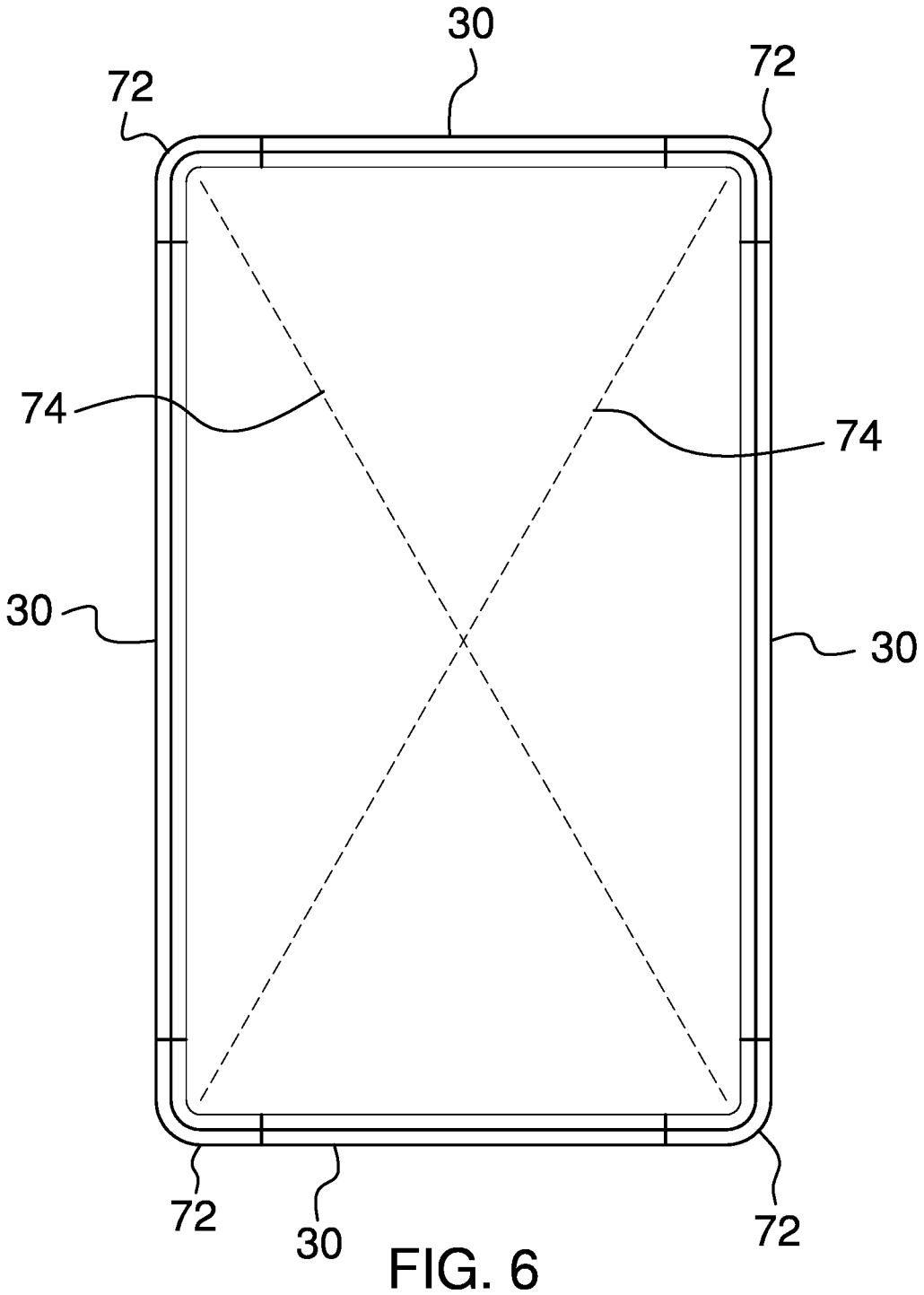
FIG. 6 is a top view of an alternative embodiment of the disclosure.
Figure 7:
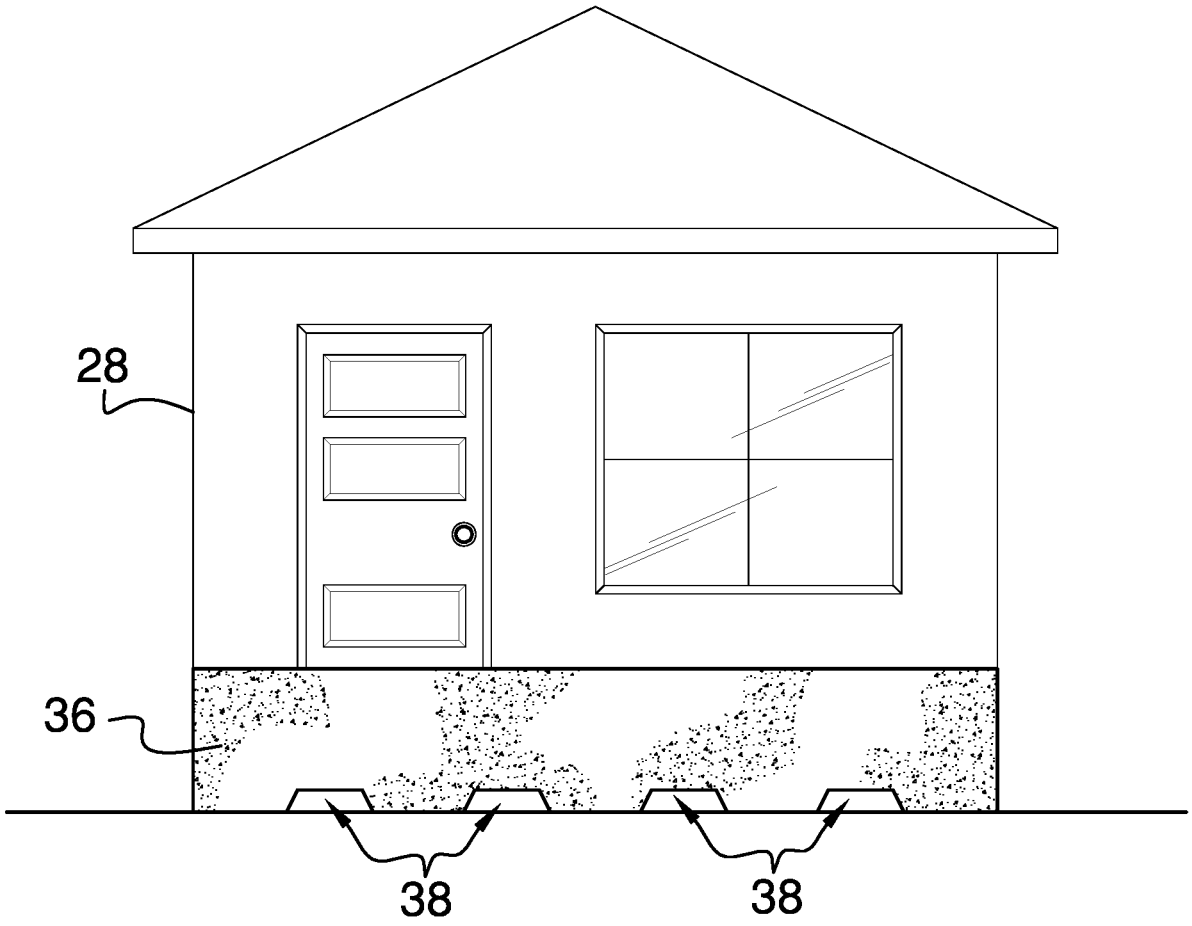
FIG. 7 is a perspective in-use view of an embodiment of the disclosure.

With reference now to the drawings, and in particular to FIGS. 1 through 7 thereof, a new foundation device embodying the principles and concepts of an embodiment of the disclosure and generally designated by the reference numeral 10 will be described.

As best illustrated in FIGS. 1 through 7, the modular foundation assembly 10 generally comprises a tarp 12 that has a plurality of openings 14 each is strategically positioned on the tarp 12. The tarp 12 is positioned on the ground 16 such that each of the openings 14 facilitates the ground 16 to be marked for a foundation. The tarp 12 has a top surface 18, a bottom surface 20 and a perimeter edge 22 extending between the top surface 18 and the bottom surface 20, and each of the openings 14 extends through the top surface 18 and the bottom surface 20. The plurality of openings 14 is spaced apart from each other and is distributed around the perimeter edge 22. Each of the openings 14 has a bounding edge 24 and the bounding edge 24 of each of the openings 14 has a plurality of intersecting sides 26 that are perpendicularly oriented with each other such that each of the openings 14 has a rectangular shape. The openings 14 are spaced apart from each other a pre-determined distance that corresponds to an intended footprint of a house 28 that is being constructed.

A plurality of concrete forms 30 is provided and each of the concrete forms 30 has a front face 32 which slopes away from a rear face 34 such that each of the concrete forms 30 has a trapezoidal shape. In this way each of the concrete forms 30 can be lifted upwardly from a concrete member 36 formed by the concrete forms 30 when the concrete member 36 has cured. Thus, the concrete forms 30 can be arranged to define a rectangle for pouring a foundation for the house 28. Each of the concrete forms 30 has a crenellated edge 37 such that each of the concrete forms 30 can form a series of slots 38 into the concrete member 36. In this way the concrete member 36 can be lifted with a forklift when the concrete member 36 has been cured. Furthermore, each of the concrete forms 30 has a length that corresponds to the intended footprint of the house 28 being constructed.

Each of the concrete forms 30 has a first lateral face 40 and a second lateral face 42 each extending between the front face 32 and the rear face 34. Additionally, each of the concrete forms 30 is elongated between the first lateral face 40 and the second lateral face 42. Each of the front face 32 and the rear face 34 has a top edge 44 and a bottom edge 46, and the front face 32 is oriented to slope away from the rear face 34 between the top edge 44 and the bottom edge 46 of the front face 32. In this way each of the concrete forms 30 has a trapezoidal cross section taken along a line extending between the first lateral face 40 and the second lateral face 42.

The bottom edge 46 of each of the front face 32 and the rear face 34 is crenellated, and each of the crenellations 48 has an upper edge 50 and a pair of lateral edges 52. Each of the lateral edges 52 angles away from the upper edge 50 such that each of the crenellations 48 has a trapezoidal shape. Furthermore, each of the crenellations 48 in the front face 32 is aligned with a respective one of the crenellations 48 in the rear face 34. The first lateral face 40 has a pair of first rebar holes 54 extending through the first lateral face 40 and the first rebar holes 54 are vertically distributed on the first lateral face 40. The second lateral face 42 has a pair of second rebar holes 56 extending through the second lateral face 42 and the second rebar holes 56 are vertically distributed on the second lateral face 42. Furthermore, the first rebar holes 54 and the second rebar holes 56 facilitate rebar 58 to be slid into the concrete form 30 when the concrete form 30 is filled with concrete.

The front face 32 has a plurality of bolt holes 60 each extending through the front face 32. Each of the bolt holes 60 facilitates a bolt to be extended through the bolt holes 60 for forming a bolt hole into the concrete member 36 when the concrete member 36 has cured. Each of the bolt holes 60 is spaced downwardly from the top edge 44 of the front face 32. Additionally, the plurality of bolt holes 60 is spaced apart from each other and is distributed between the first lateral face 40 and the second lateral face 42.

A plurality of rods 62 is provided and each of the rods 62 is coupled to a respective one of the concrete forms 30. Furthermore, each of the rods 62 is bent into an arch to define a grip 63. The grip 63 defined by each of the rods 62 is gripped for lifting the concrete forms 30 from the concrete member 36 when the concrete member 36 has cured. Each of the rods 62 has a first end 64 and a second end 66, and each of the rods 62 is elongated between the first end 64 and the second end 66. Each of the rods 62 is coupled to a front surface 68 of the front face 32 and a rear surface 70 of the rear face 34 having the rods 62 curving upwardly over the top edge 44 of the front face 32 and the top edge 44 of the rear face 34. The rods 62 on each of the concrete forms 30 are spaced apart from each other and are distributed between the first lateral face 40 and the second lateral face 42 of the concrete forms 30. Additionally, each of the rods 62 is comprised of a rigid material thereby inhibiting the top edge 44 of the front face 32 from moving away from the top edge 44 of the rear face 34 when the concrete form is filled with concrete.

In use, the tarp 12 is laid onto the ground 16 and the ground 16 is marked through each of the openings 14 in the tarp 12. The ground 16 can be marked with construction chalk, spray paint or other preferred method. The tarp 12 is removed from the ground 16 and the ground 16 is excavated as required in order to level the ground 16 along the markings. Each of the concrete forms 30 is filled with concrete to form the concrete member 36 and each of the concrete forms 30 is lifted upwardly from the concrete member 36 when the concrete member 36 has cured. Additionally, each of the concrete members 36 is lifted with a forklift, or other type of machine, and each of the concrete members 36 is set into place to match the openings 14 that were marked with the tarp 12. In this way a foundation for a house 28 of predetermined dimensions can be assembled in a modular fashion.

The series of slots formed into the concrete member 36 facilitates the house 28 that is constructed on the foundation to be moved with a forklift or other similar type of machine. As is most clearly shown in FIG. 6, a pair of curved concrete forms 72 may be provided and each of the curved concrete forms 72 can be positioned between a respective pair of the concrete forms 30. In this way the curved concrete forms 72 and the concrete forms 30 can define a rectangle with rounded corners. Additionally, as is further illustrated in FIG. 6, chains 74 of equal length can be coupled to extend diagonally between a respective pair of the curved concrete forms 72 to ensure the rectangle formed is oriented plumb and square.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular foundation assembly for constructing a foundation for a building that can be relocated multiple times, said assembly comprising:

a tarp having a plurality of openings each being strategically positioned on said tarp wherein said tarp is configured to be positioned on the ground such that each of said openings facilitates the ground to be marked for a foundation;

a plurality of concrete forms, each of said concrete forms having a front face sloping away from a rear face such that each of said concrete forms has a trapezoidal shape, each of said concrete forms having a crenellated edge wherein each of said concrete forms is configured to form a series of slots into a concrete member formed in the concrete forms thereby facilitating the concrete member to be lifted with a forklift; and a plurality of rods, each of said rods being coupled to a respective one of said concrete forms, each of said rods being bent into an arch to define a grip wherein said grip defined by each of said rods is configured to be gripped for lifting said concrete forms from the concrete member when the concrete member has cured.

2. The assembly according to claim 1, wherein said tarp has a top surface, a bottom surface and a perimeter edge extending between said top surface and said bottom surface, each of said openings extending through said top surface and said bottom surface, said plurality of openings being spaced apart from each other and being distributed around said perimeter edge, each of said openings having a bounding edge, said bounding edge of each of said openings having a plurality of intersecting sides being perpendicularly oriented with each other such that each of said openings has a rectangular shape.

3. The assembly according to claim 1, wherein each of said concrete forms has a first lateral face and a second lateral face each extending between said front face and said rear face, each of said concrete forms being elongated between said first lateral face and said second lateral face, each of said front face and said rear face having a top edge and a bottom edge, said front face being oriented to slope away from said rear face between said top edge and said bottom edge of said front face such that each of said concrete forms has a trapezoidal cross section taken along a line extending between said first lateral face and said second lateral face.

4. The assembly according to claim 3, wherein said bottom edge of each of said front face and said rear face is crenellated, each of said crenellations having an upper edge and a pair of lateral edges, each of said lateral edges angling away from said upper edge such that each of said crenellations has a trapezoidal shape, each of said crenellations in said front face being aligned with a respective one of said crenellations in said rear face.

5. The assembly according to claim 3, wherein said first lateral face has a pair of first rebar holes extending through said first lateral face, said first rebar holes being vertically distributed on said first lateral face.

6. The assembly according to claim 5, wherein said second lateral face has a pair of second rebar holes extending through said second lateral face, said second rebar holes being vertically distributed on said second lateral face, said first rebar holes and said second rebar holes being configured to facilitate rebar to be slid into said concrete form when said concrete form is filled with concrete.

7. The assembly according to claim 3, wherein said front face has a plurality of bolt holes each extending through said front face wherein each of said bolt holes is configured to facilitate a bolt to be extended through said bolt holes for forming a bolt hole into the concrete member when the concrete member has cured, each of said bolt holes being spaced downwardly from said top edge of said front face, said plurality of bolt holes being spaced apart from each other and being distributed between said first lateral face and said second lateral face.

8. The assembly according to claim 3, further comprising each of said rods has a first end and a second end, each of said rods being elongated between said first end and said second end, each of said rods being coupled to a front surface of said front face and a rear surface of said rear face having said rods curving upwardly over said top edge of said front face and said top edge of said rear face, said rods on each of said concrete forms being spaced apart from each other and being distributed between said first lateral face and said second lateral face of said concrete forms.

9. The assembly according to claim 8, wherein each of said rods is comprised of a rigid material thereby inhibiting said top edge of said front face from moving away from said top edge of said rear face when said concrete form is filled with concrete.

10. A modular foundation assembly for constructing a foundation for a building that can be relocated multiple times, said assembly comprising:

a tarp having a plurality of openings each being strategically positioned on said tarp wherein said tarp is configured to be positioned on the ground such that each of said openings facilitates the ground to be marked for a foundation, said tarp having a top surface, a bottom surface and a perimeter edge extending between said top surface and said bottom surface, each of said openings extending through said top surface and said bottom surface, said plurality of openings being spaced apart from each other and being distributed around said perimeter edge, each of said openings having a bounding edge, said bounding edge of each of said openings having a plurality of intersecting sides being perpendicularly oriented with each other such that each of said openings has a rectangular shape;

a plurality of concrete forms, each of said concrete forms having a front face sloping away from a rear face such that each of said concrete forms has a trapezoidal shape, each of said concrete forms having a crenellated edge wherein each of said concrete forms is configured to form a series of slots into a concrete member formed in the concrete forms thereby facilitating the concrete member to be lifted with a forklift, each of said concrete forms having a first lateral face and a second lateral face each extending between said front face and said rear face, each of said concrete forms being elongated between said first lateral face and said second lateral face, each of said front face and said rear face having a top edge and a bottom edge, said front face being oriented to slope away from said rear face between said top edge and said bottom edge of said front face such that each of said concrete forms has a trapezoidal cross section taken along a line extending between said first lateral face and said second lateral face, said bottom edge of each of said front face and said rear face being crenellated, each of said crenellations having an upper edge and a pair of lateral edges, each of said lateral edges angling away from said upper edge such that each of said crenellations has a trapezoidal shape, each of said crenellations in said front face being aligned with a respective one of said crenellations in said rear face, said first lateral face having a pair of first rebar holes extending through said first lateral face, said first rebar holes being vertically distributed on said first lateral face, said second lateral face having a pair of second rebar holes extending through said second lateral face, said second rebar holes being vertically distributed on said second lateral face, said first rebar holes and said second rebar holes being configured to facilitate rebar to be slid into said concrete form when said concrete form is filled with concrete, said front face having a plurality of bolt holes each extending through said front face wherein each of said bolt holes is configured to facilitate a bolt to be extended through said bolt holes for forming a bolt hole into the concrete member when the concrete member has cured, each of said bolt holes being spaced downwardly from said top edge of said front face, said plurality of bolt holes being spaced apart from each other and being distributed between said first lateral face and said second lateral face; and a plurality of rods, each of said rods being coupled to a respective one of said concrete forms, each of said rods being bent into an arch to define a grip wherein said grip defined by each of said rods is configured to be gripped for lifting said concrete forms from the concrete member when the concrete member has cured, each of said rods having a first end and a second end, each of said rods being elongated between said first end and said second end, each of said rods being coupled to a front surface of said front face and a rear surface of said rear face having said rods curving upwardly over said top edge of said front face and said top edge of said rear face, said rods on each of said concrete forms being spaced apart from each other and being distributed between said first lateral face and said second lateral face of said concrete forms, each of said rods being comprised of a rigid material thereby inhibiting said top edge of said front face from moving away from said top edge of said rear face when said concrete form is filled with concrete.

11. A method of assembling a modular house, the steps of the method comprising:

providing a tarp having a plurality of openings each being strategically positioned on said tarp wherein said tarp is configured to be positioned on the ground such that each of said openings facilitates the ground to be marked for a foundation;

providing a plurality of concrete forms, each of said concrete forms having a front face sloping away from a rear face such that each of said concrete forms has a trapezoidal shape, each of said concrete forms having a crenellated edge wherein each of said concrete forms is configured to form a series of slots into the concrete member thereby facilitating a concrete member formed in the concrete forms to be lifted with a forklift;

placing said tarp on the ground in a pre-determined location;

marking the ground through each of said openings in said tarp;

removing said tarp from the ground;

excavating the ground at each area being marked through said openings of said tarp;

pouring concrete into each of said concrete forms to form a plurality of concrete members;

lifting each of said concrete forms upwardly from said concrete member formed in said concrete forms when said concrete member has cured;

transporting each of said concrete members with a forklift to the pre-determined location at which said tarp was laid out and said openings were marked to define the foundation for a house; and constructing the house on top of the foundation defined by said concrete members.

* * * * *